United States Patent [19]

Hall

[11] Patent Number: 4,833,496

[45] Date of Patent: May 23, 1989

[54] WEB GUIDING APPARATUS

[75] Inventor: Douglas O. Hall, Farmington, N.Y.

[73] Assignee: Eastman Kodak Company, Rochester, N.Y.

[21] Appl. No.: 188,867

[22] Filed: May 2, 1988

[51] Int. Cl.[4] ..... G03D 3/13

[52] U.S. Cl. ..... 354/338; 354/321; 226/189; 226/196

[58] Field of Search ..... 354/338, 339, 320, 321, 354/322; 226/196, 197, 198, 199, 188, 189, 171; 134/64 P, 122 P

[56] References Cited

U.S. PATENT DOCUMENTS

| | | | |
|---|---|---|---|
| 1,574,591 | 2/1926 | Adatte | 354/339 |
| 2,913,974 | 10/1956 | Sabel et al. | 354/322 |
| 3,492,933 | 2/1970 | Knibiehly et al. | 134/122 P |
| 3,747,499 | 7/1973 | Foster | 354/339 |
| 3,779,439 | 12/1973 | Fessop | 226/199 |
| 3,788,153 | 1/1974 | Lee | 226/189 |
| 4,002,280 | 1/1977 | Coleman et al. | 226/171 |
| 4,307,831 | 12/1981 | Hope et al. | 226/189 |
| 4,312,470 | 1/1982 | Hope et al. | 354/321 |
| 4,666,279 | 5/1987 | Fujita | 354/339 |
| 4,687,313 | 8/1987 | Taniguchi et al. | 354/320 |

*Primary Examiner*—A. A. Mathews

*Attorney, Agent, or Firm*—James S. Smith

[57] ABSTRACT

A film guide shoe for a film processor is supported on the shafts of two pinch rollers which are biased into contact with a turnaround roller. The guide shoe moves with the pinch rollers as the filmstrip passes between each pinch roller and the turnaround roller.

4 Claims, 2 Drawing Sheets

WEB GUIDING APPARATUS

BACKGROUND OF THE INVENTION

1. Field of the Invention

The present invention relates to apparatus for guiding web material along a predetermined path and, more particularly, to an improved film guide for a film processor.

2. Description of the Prior Art

Numerous kinds of apparatus for processing photographic film have heretofore been devised. One well known apparatus which is adapted for use with film strip material, includes a plurality of tanks each of which contain a different film processing liquid such as developing solution, a fixing solution and a washing solution. The tanks are arranged in fixed, aligned relation in order that an exposed film strip may be advanced from tank to tank and successively treated by the different processing liquids. To effect such film strip advance the film processing apparatus further includes several groupings of vertically disposed rollers which are respectively immersed in the different processing liquids, within the tanks, for moving the exposed film strip through such liquids. Other rollers are located between the tanks for moving the exposed film strip from tank to tank. Together these rollers define a film strip advance path which interconnects the tanks. Upon rotatably driving all of the rollers, the exposed film strip will be moved along the film strip advance path from tank to tank and will be successively immersed in the different processing liquids. Such apparatus is disclosed in U.S. Pat. Nos. 3,779,439, 2,913,974, 1,574,591.

With each tank a plurality of rollers are rotatably supported on a rack. A first group of rollers cooperate to move the film strip in a downward direction generally within a vertical plane and a second group of rollers cooperate to move the film strip in an upward direction generally within a vertical plane which is spaced from and parallel to the first mentioned vertical plane. At the bottom of the tank a turnaround roller is positioned adjacent the lowermost roller of each group. The lowermost roller of each group is biased into contact with the turn around roller so that the film strip will move between the lowermost roller of the first group and the turn around roller, around the turn around roller and between the turn around roller and the lowermost roller of the second group and then upwardly through the other rollers of the second group. The film strip is typically guided around the turn around roller by guide shoes supported on the rack. One guide shoe positioned directly below the turnaround roller and between the two lowermost rollers provides a curved surface in close proximity to the turn around roller to cause the film strip to move in a curved semicircular path around the turn around roller to reverse its direction of movement from a downward direction to an upward direction.

While such prior art guide shoes serve their intended purpose they have certain disadvantages resulting from their rigid mounts and fixed position relative to the lowermost roller of each group and the turn around roller. Due to imperfect manufacturing processes the tolerance buildup between the rollers, the roller mounts, the rack interface for the roller mounts, the rack interface for the guide shoe mounts, the guide surface can add up to substantial dimensional variations. Also, because the lowermost rollers are biased into contact with the turn around roller passage of the film between each lowermost roller and the turnaround roller causes displacement of the roller relative to the turn around roller and the guide shoe. This causes the film to remain in contact with the guide shoe after it is threaded through the system possibly causing scratches of the film emulsion.

Allowance for such movement also increases the tolerance requirements of the system. Taking into account all of these required tolerances complicates the manufacturing process. Failure to take them into account contributes to less than optimum guide shoe performance and causes film artifacts.

SUMMARY OF THE INVENTION

In accordance with a preferred embodiment of the present invention a film guide shoe for a film processor is supported on the shafts of two rollers which are spring biased into contact with a turn around roller. With this arrangement the guide shoe moves with the rollers as the film strip passes between each roller and the turn around roller and alleviates the need for rigid manufacturing tolerances of the type required for a fixed guide shoe.

BRIEF DESCRIPTION OF THE DRAWINGS

Other advantages of the present invention will become apparent from the following detailed description of a preferred embodiment taken in connection with the accompanying drawings, wherein.

DETAILED DESCRIPTION OF THE INVENTION

Figure 1:
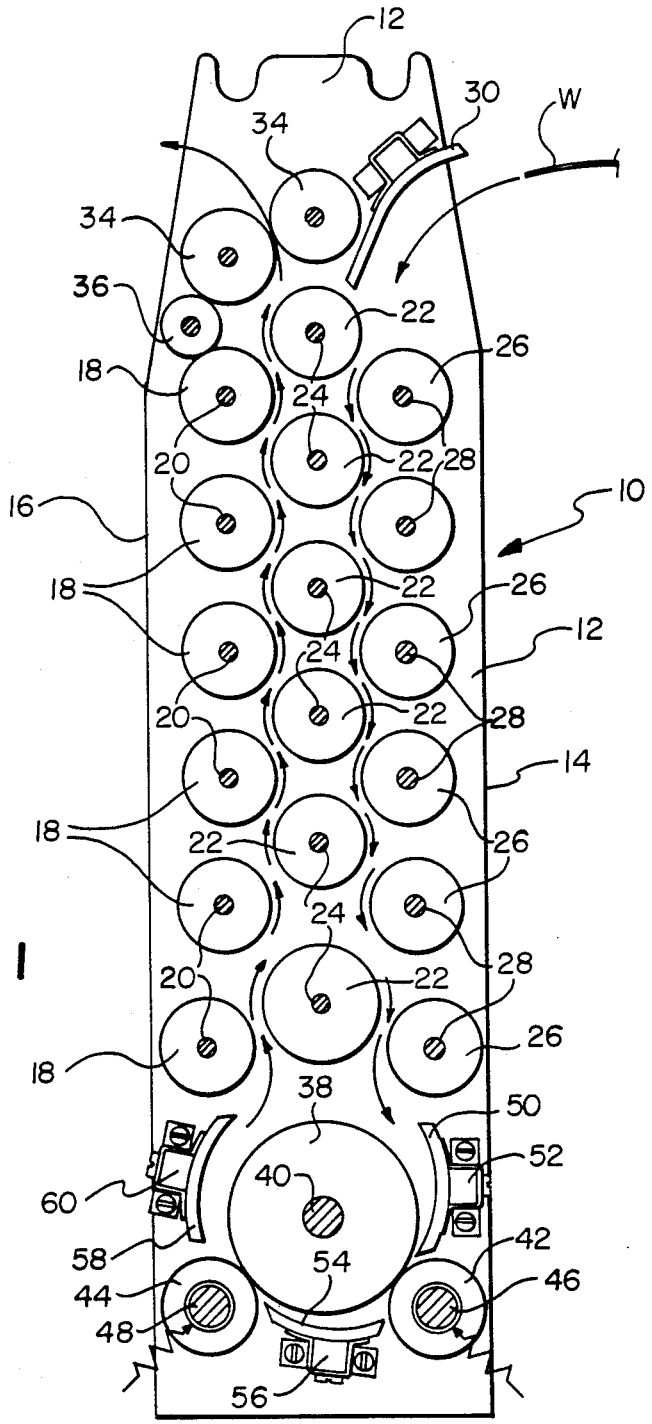
FIG. 1 is a side elevation view of a prior art film processor roller rack showing the film path, film rollers and film guides.

Referring now to the drawings and in particular to FIG. 1, there is shown a prior art roller rack 10 for a film processor having a side plate 12, and a spaced front side plate (not shown) removed to reveal the internal parts of the rack. As shown in FIG. 1 a first group of rollers 18 are rotatably mounted on the rear side plate 12 and the front side plate (not shown) by means of suitable shafts 20 extending between the side plates. The first group of rollers 18 are positioned so that their respective axis of rotation extend horizontally, one under the other, and lie in a single vertical plane to form a first vertically aligned array of parallel spaced rollers. In a similar manner, second and third groups of rollers 22 and 26 are individually rotatably supported on shafts 24 and 28 respectively to form second and third vertically aligned groups of parallel spaced rollers.

Each of the rollers in the first, second and third groups are interconnected by a number of gear wheels (not shown) in a manner well known in the art. These gear wheels are rotated at the same speed by an appropriate drive means (not shown). The arrangement between the gear wheels and the first, second and third groups of rollers is such that the first and third groups of rollers 18 and 26 are rotated in the same direction and the second group of rollers are rotated in an opposite direction as indicated in FIG. 1. Thus the second and third groups of rollers 22 and 26 will cooperate to move a film or paper web W downward and rollers 18 and 22 cooperate to move the film strip upward as indicated by the arrows to define a downward film path and a return upward film path.

The web is directed into the processor and into the downward film path by a curved guide 30 attached to the rear side plate by a bracket 32. The web exits the upward path through a pair of nip rollers 34 one of which is engaged by a rewet roller 36.

Refering now to the lower portion of the processor shown in FIG. 1 a larger turn around roller 38 rotatably supported on a shaft 40 is positioned below the three groups of rollers 18, 22 and 26 to provide a web turn around path. A pair of pinch rollers 42 and 44 are rotatably mounted on shafts 46 and 48 respectively and are spring biased into engagement with the periphery of turn around roller 38.

A curved film guide shoe 50 positioned to the right of the turn around roller 38 and supported on the rear side plate 12 by a suitable bracket 52, serves to direct the end of the film web into the nip between roller 38 and roller 42. A second curved guide shoe 54 supported on the rear side plate 12 by a suitable bracket 56 serves to direct the end of the web into the nip between rollers 44 and 38. A curved guide shoe 58 supported by a bracket 59 and positioned to the left of the turn around roller 38 serves to deflect the web end into the upward film path defined by roller groups 18 and 22.

Referring now specifically to the function of the second guide shoe 54 the position of its curved surface relative to the drive rollers 42 and 44 is critical and tight tolerances must be maintained. If the manufacturing process is imperfect, tolerances between the rollers 38, 42 and 44, the bracket, the side plate mounts for the roller shafts 40, 46 and 48, the side plate mounts for the guide shoe bracket 56, bracket 56 itself and the guide shoe 54 itself will result in substantial tolerance buildup. Also as the film moves between the rollers 38 and 42 the roller 42 moves and changes the relationship of the shoe 54 to the roller 42. These possible tolerance accumulations and changes in the relationship of roller 42 to the shoe 54 are potential causes of film artifacts and thus poor film processing quality. More specifically if the left end of shoe 54 is not spaced closely to the surface of turn around roller 38 and in close proximity to the nip of rollers 38 and 44, the leading edge of the film will stub against roller 44 prior to entering the nip between roller 44 and roller 38. This stubing causes the film to hesitate and roller 42 and 38 to rotate against the stationary film resulting in scratching of the film emulsion. Only through maintenance of extremely tight unrealistic tolerances can this result be avoided.

Another disadvantage of the prior art guide shoe 54 is that it has a fixed position. When the leading end of the film moves into the nip of rollers 38 and 44, roller 44 is displaced away from roller 38. However, the position of guide shoe 54 does not change and the film remains in contact with the guide shoe 54 during operation of the processor possibly causing scratching of the film emulsion.

Figure 2:
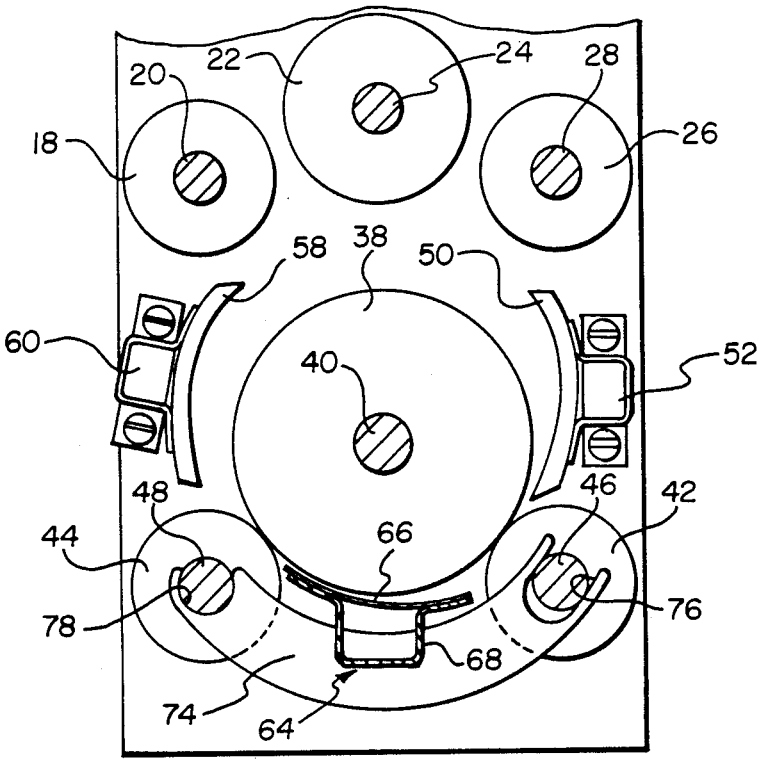
FIG. 2 is a partial side elevation view of a film processor roller rack illustrating a film guide shoe in accordance with the invention.
Figure 3:
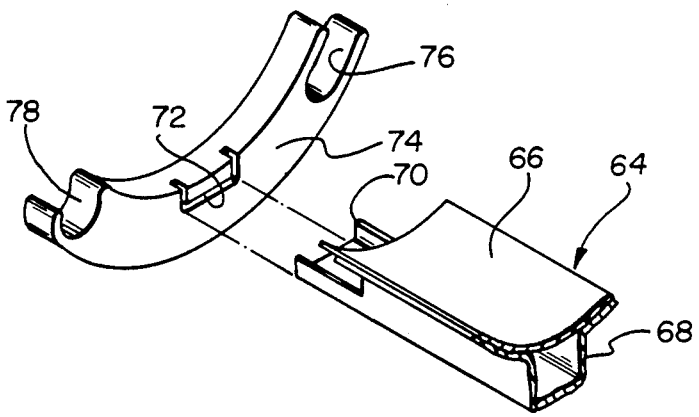
FIG. 3 is an exploded perspective view of the film guide shoe and supporting structure shown in FIG. 2.

Referring now to FIG. 2 there is shown an improved processor in accordance with the invention. In the embodiment shown in FIG. 2 a lower guide shoe 64 positioned between rollers 42 and 44 comprises a thin curved plate 66 attached to a U-shaped bracket 68 having a portion 70 extending from one end beyond the end of the curved plate 66. The extended portion 70 is adapted to be received by a complemental U-shaped slot 72 in a curved mounting plate 74. One end of the plate 74 is provided with a semicircular recess 76 sized to receive the shaft 40 of roller 42. The opposite end of plate 74 is provided with a similar circular recess 78 adapted to receive the shaft 48 of roller 44. The recess 78 is slightly greater than semicircular and the entrance to the recess is slightly smaller then the diameter of the shaft 48 so that the end of the plate can be snap fitted over shaft 48. To assemble the film guide shoe 64 and install it on the rack the guide shoe 64 is first mounted in the plate 74 through insertion of its extension 70 into slot 72 of the curved plate 74. The curved plate is then positioned in the rack with the curved recess 76 fitted over shaft 46. Final positioning is achieved by snap fitting the curved cutout 78 over shaft 48 to thus position the curved plate 74 and guide shoe 64 as shown in FIG. 2.

The advantages of the guide shoe 64 will now be apparent. Because the guide shoe is mounted by plate 74 directly on the roller shafts 48 and 46, it will not be affected by variations in tolerances of the type described above. The only tolerance variations that need be controlled are those of the guide shoe 64 and its supporting plate 74. Thus the manufacturing cost of the guide shoe is substantially less than that of the prior art shoe described above. Also, due to the reduction in manufacturing tolerances the shoe 64 can be positioned in closer proximity to the nip of rollers 38 and 44.

Because of the direct mounting of the guide shoe 64 on the roller shafts displacement of roller 44 by the leading film end will cause a corresponding displacement of guide shoe 64 and reduce the possibility of the filmstrip remaining in contact with the guide shoe after it is threaded through the nip of rollers 38 and 44.

The present invention has been described in detail with particular reference to a perferred embodiment thereof, but it will be understood that variations and modifications can be effected within the spirit and scope of the invention.

I claim:

1. An improved web guiding apparatus of the kind for use with a flexiable web, said apparatus comprising:

a turn around roller;

a pair of spaced pinch rollers positioned in driving engagement with said turnaround roller;

each of said pinch rollers defining a nip with said turnaround roller;

a pair of shafts for rotatably supporting said pinch rollers respectively first guide means for directing the end of the web into the nip defined by one of said pinch rollers to cause the web to move between the said one pinch roller and said turnaround roller;

second guide means for directing the end of the web upon movement through said nip toward the nip defined by the other of said pinch rollers; and means for supporting said second guide means on said roller shafts.

2. An improved web guiding apparatus as claimed in claim 1 wherein said second guide means comprises a curved plate positioned in close proximity to said turn around roller.

3. An improved web guiding apparatus as claimed in claim 2 wherein said supporting means includes a mounting plate for supporting said curved plate, said mounting plate being supported on said roller shafts.

4. An improved web guiding apparatus as claimed in claim 3 wherein said mounting plate has a curved recess in one end thereof adapted to be fitted over one of said roller shafts and a curved recess in the other end thereof adapted to be snap fitted over the other of said roller shafts.

* * * * *

UNITED STATES PATENT AND TRADEMARK OFFICE

CERTIFICATE OF CORRECTION

PATENT NO. : 4,833,496

DATED : May 23, 1989

INVENTOR(S) : Douglas O. Hall

It is certified that error appears in the above-identified patent and that said Letters Patent is hereby corrected as shown below:

| | |
|---|---|
| Right Column, Cover, Line above Abstract | "James S. Smith" should read --James A. Smith-- |
| Column 3, line 11, | "Refering" should read --Referring--. |

Signed and Sealed this

Seventh Day of August, 1990

*Attest:*

HARRY F. MANBECK, JR.

*Attesting Officer*

*Commissioner of Patents and Trademarks*